United States Patent [19]

Schulz

[11] Patent Number: 4,781,247

[45] Date of Patent: Nov. 1, 1988

[54] HEAT EXCHANGER FOR THE COOLANT CIRCUIT OF INTERNAL COMBUSTION ENGINES

[75] Inventor: Joachim Schulz, Amorbach, Fed. Rep. of Germany

[73] Assignee: Aurora Konrad G. Schulz GmbH & Co., Mudau/Odenwald, Fed. Rep. of Germany

[21] Appl. No.: 85,531

[22] Filed: Aug. 14, 1987

[30] Foreign Application Priority Data

Aug. 14, 1986 [EP] European Pat. Off. ..... 86111269.6

[51] Int. Cl.[4] ..... F01P 11/02; F28F 23/00

[52] U.S. Cl. ..... 165/104.32; 165/110; 165/917

[58] Field of Search ..... 165/110, 917, 104.32

[56] References Cited

FOREIGN PATENT DOCUMENTS 598044 5/1960 Canada ..... 165/110

684969 4/1964 Canada ..... 165/110

*Primary Examiner*—Albert W. Davis, Jr.

*Attorney, Agent, or Firm*—Becker & Becker, Inc.

[57] ABSTRACT

A heat exchanger, in the form of a radiator, for the coolant circuit of an internal combustion engine. The radiator has an upper water tank, a lower water tank that is connected to a return line, and heat exchanger tubes that extend between the upper and lower water tanks. For more uniform thermal transmission, an air-withdrawal line extends through the heat exchanger register and the lower water tank into the return line.

11 Claims, 2 Drawing Sheets

HEAT EXCHANGER FOR THE COOLANT CIRCUIT OF INTERNAL COMBUSTION ENGINES

BACKGROUND OF THE INVENTION

The present invention relates to a heat exchanger for the coolant circuit of an internal combustion engine. The heat exchanger includes an upper water tank, a lower water tank that is connected to a return line, heat exchanger tubes that extend between the upper and lower water tanks, and an air-withdrawal line that extends from the upper water tank into the region of the lower water tank.

It is known to provide a so-called by-pass line in a heat exchanger that is designed as a radiator. Air that accumulates in the upper water tank is withdrawn via this by-pass line. It has been attempted to increase the withdrawal efficiency by disposing between the heat exchanger register and the upper water tank a partition that has a relatively small opening. The by-pass line has a larger, free, cross-sectional area than does the opening in the partition. Unfortunately, this arrangement has a relatively low withdrawal efficiency. Where there is a greater yield of air in the cooler, there is a danger that the air that is present can no longer be completely removed, so that the cooling capacity decreases.

It is also known pursuant to a different construction to make the free, cross-sectional area of the opening in the partition greater than that of the by-pass line. This is an attempt to have the air bubbles from the heat exchanger, which is similarly designed as a radiator, pass more quickly into the upper water tank, and to have the radiator filled more quickly with coolant. However, this arrangement also provides only a low withdrawal capacity or efficiency, so that when the air yield is great, the radiator is filled with air and can no longer bring about a cooling effect. Since gas and air bubbles contained in the coolant also reduce the efficiency of radiators that are disposed in the coolant circuit of internal combustion engines, it is an object of the present invention to provide a heat exchanger that assures an improved, and especially a more uniform, transmission of heat.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The present invention is characterized primarily in that the heat exchanger is embodied as a radiator, and the air-withdrawal line extends through the lower water tank into the return line.

With such a configuration, the advantage is obtained that the gas or air bubbles that rise in the heat exchanger or radiator and collect in the upper region of the upper water tank are constantly withdrawn. As a result, the radiator is filled more uniformly and completely with coolant, so that the thermal efficiency of the radiator increases considerably. Due to the increased efficiency, the radiator can even be built more compactly.

Due to the fact that one of the heat exchanger tubes is used as the air-withdrawal line, the structural expense for the inventive configuration is considerably reduced. In order to facilitate the passage of the gas and air bubbles, the upper opening of the air-withdrawal line is expediently widened. This widening can be a conical widening, and the free rim of the inlet opening is advantageously rounded in order to promote a resistance-free introduction of gas or air bubbles into the air-withdrawal line.

Since the air-withdrawal line extends into the return line in which the coolant is pumped back into the motor via the cooling water pump, the flow velocity in the region of the lower opening of the air-withdrawal line is relatively high. This results in a substantial vacuum within the air-withdrawal line. This vacuum accelerates the flow within the withdrawal line, and is particularly effective at the inlet opening for the gas or air bubbles. As a result, gas and air accumulations can be reliably withdrawn from the upper water tank via a relatively thin withdrawal line.

It is furthermore especially advantageous to use a conventional heat exchanger tube for the air-withdrawal line, with this tube being extended beyond the bases or plates of the heat exchanger register portion, or with extensions being soldered onto this tube. With the conventional tubes, which are oval or oblong in a ratio of 1:5 to 10, the widening can be easily accomplished via any conical tool. The inventive construction has the further advantage that it is unnecesary to have a special venting tube. In addition to reducing the material and labor costs, this offers the possibility of saving weight, and also avoids the additional sealing and space problems that arise when external venting tubes are utilized.

From a thermal standpoint, it is advantageous to utilize only one of the existing heat exchanger tubes for the venting, i.e., the removal of air. This does not adversely affect the efficiency of the radiator, especially if that heat exchanger tube that is embodied as the air-withdrawal line is disposed in the central region of the radiator.

Further specific features of the present invention will be described in detail subsequently.

DESCRIPTION OF PREFERRED EMBODIMENTS

Figure 1:
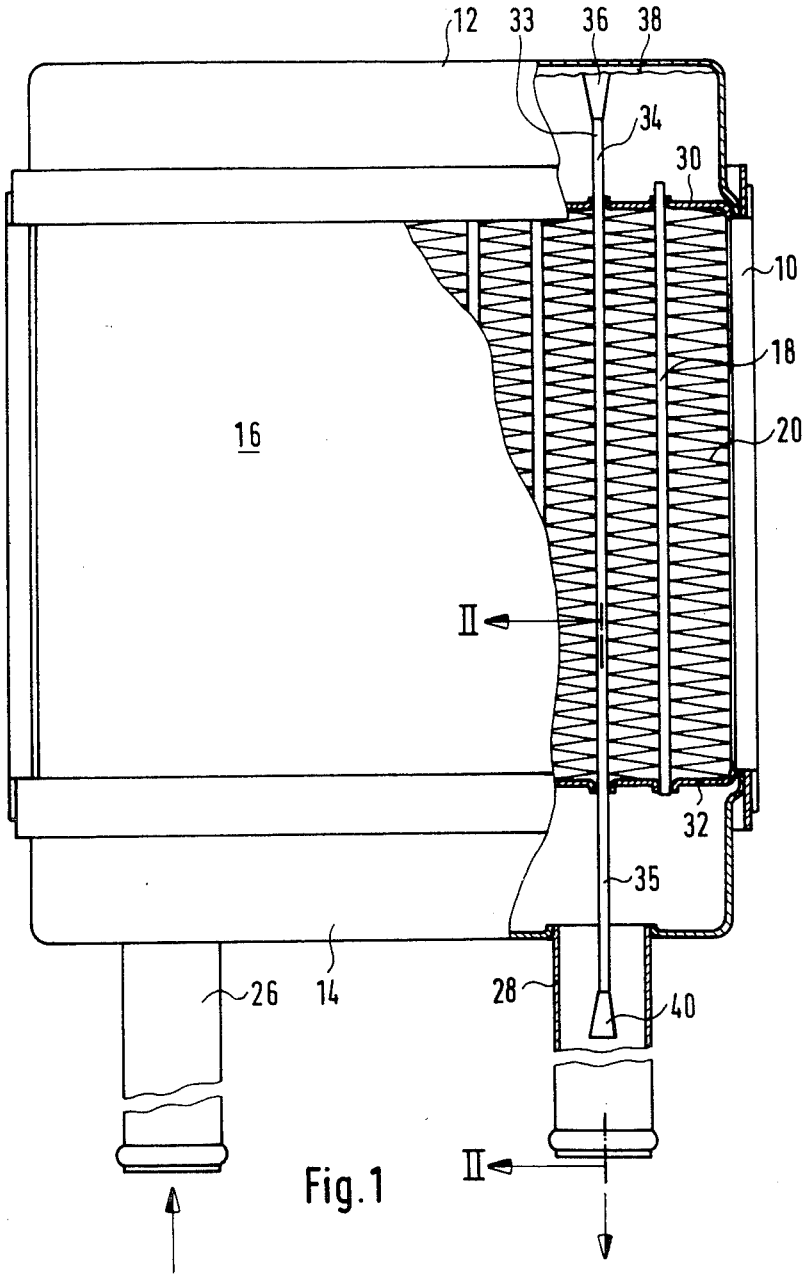
FIG. 1 is a partially broken-away front view of one exemplary embodiment of an inventive heat exchanger embodied as a radiator.

Referring now to the drawings in detail, the radiator 10 illustrated in FIG. 1 has an upper water tank 12 with an air-elimination region, and a lower water tank 14; a heat exchanger register 16 extends between these two water tanks. The register 16 is comprised of heat exchanger tubes 18 and fins 20 that are in good thermal contact with the tubes 18. Warm cooling water passes from the motor, through the intake 26, into the radiator 10 and the tubes 18, from where the water passes into the lower water tank 14 and is withdrawn via a return line 28.

The tubes 18 are brazed or hard-soldered into suitable bases or plates 32. An air-withdrawal line 34 is also mounted in the plates 30 and 32, with the cross-sectional area of the line 34 in the region of the register 16 corresponding completely to the cross-sectional area of the tubes 18. The air-withdrawal line 34 extends upwardly far into the upper water tank 12.

An upper opening 36 of the air-withdrawal line 34 for gas and air bubbles ends at a water level 34 that is established during normal operation of the radiator 10. The opening 36 of the air-withdrawal line 34 is conically widened, so that its cross-sectional area is greater than the cross-sectional area of the air-withdrawal line 34 in the region of the register 16.

The air-withdrawal line 34 similarly extends downwardly beyond the base 32. The lower opening 40 of the air-withdrawal line 34 is disposed in a connector of the return line 28, which is in alignment with the air-withdrawal line 34. The lower opening 40 of the line 34 is also widened conically. The opening 40 is advantageously disposed in the middle of the connector, so that the water can flow uniformly about this opening. The extensions 33 and 35 of the air-withdrawal line 34 can also be formed by tubular pieces that are soldered onto the latter.

Via an exhauster, a zone of accelerated flow in the return line 28 is utilized in order to pump the air out of the radiator and to exhaust it a suitable location. The accelerated flow results initially due to the constriction resulting from the air-withdrawal line being introduced into the return line 28; the accelerated flow is also increased due to the conical widening of the lower opening 40 of the air-withdrawal line 34. A substantial vacuum results due to the high flow velocity at the sharp edges of the opening 40. This affects the entire air-withdrawal line 34, and causes the flow in the line 34 to be considerably greater than the flow in the tubes 18. Nevertheless, the water that flows in the air-withdrawal line 34 is also conveyed through the heat exchanger, so that here also a cooling occurs, so that the efficiency of the radiator is not reduced. Due to the substantial vacuum, air bubbles, air, and/or water are drawn in at the upper opening 36 of the air-withdrawal line 34, with predominantly air or air bubbles being withdrawn, since these tend to collect in the upper water tank 12.

Figure 2:
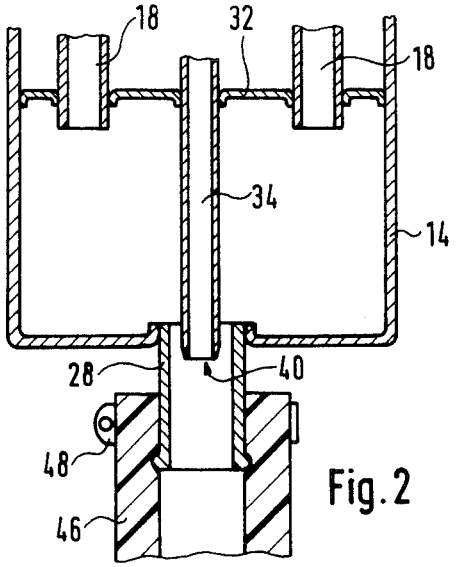
FIG. 2 is a cross-sectional view taken along the line II—II in FIG. 1.

FIG. 2 illustrates the lower portion of the air-withdrawal line 34. The line 34, as well as the heat exchanger tubes 18, have an oval cross-sectional shape with a length to width ratio of 1:5 to 10. This is advantageous for an improved effectiveness, and is not disadvantageous for the air-withdrawal line 34. Due to the conical widening of the lower opening 40 of the air-withdrawal line 34, the lower opening 40 of the line 34 appears smaller in the view of FIG. 2. In fact, however, the opening 40 has an essentially circular cross-sectional area that is greater than the cross-sectional area of the air-withdrawal line 34 in the region of the register 16. In the embodiment illustrated in FIG. 2, a radiator having three successively arranged tubes 18 is illustrated. The air-withdrawal line 34 is provided in place of the central tube, and is disposed precisely above the return line connector 28.

Placed on the connector of the return line 28 is a hose 46 that is secured to the connector via a clamp 48.

Figure 3:
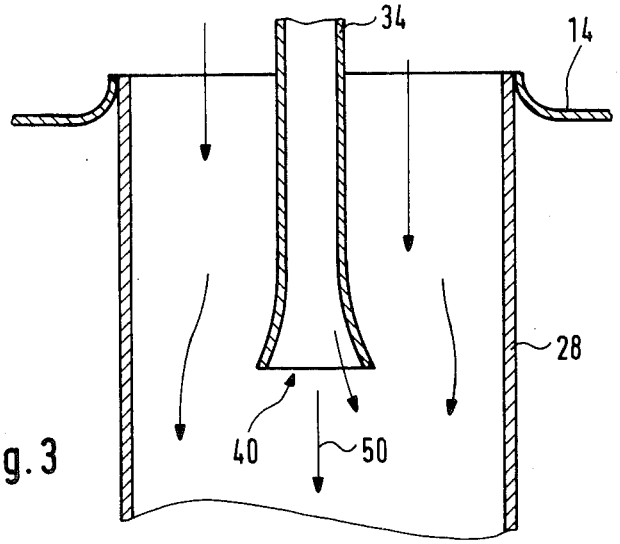
FIG. 3 is an enlarged detailed view of the return line of FIG. 1.

FIG. 3 is an enlarged view of the connector of the enlarged line 28 along with the lower opening 40 of the air-withdrawal line 34. The flow of water that results during operation is indicated by the arrows 50. In the immediate region of the opening 40, the effective cross-sectional area of the return line 28 is less than in the remaining regions. As a result, at this location there is a zone of greater vacuum that, utilizing the known water-jet pump principle, withdraws gas or air bubbles out of the radiator via the air-withdrawal line 34.

The present invention is, of course, in no way restricted to the specific disclosure of the specification and drawings, but also encompasses any modifications within the scope of the appended claims.

What I claim is:

1. In a heat exchanger for the coolant circuit of an internal combustion engine, with said heat exchanger including an upper water tank, a lower water tank that is connected to a return line, heat exchanger tubes that extend between said upper and lower water tanks, and an air-withdrawal line that extends from said upper water tank into the region of said lower water tank, the improvement wherein:

said heat exchanger is embodied as a radiator, and said air-withdrawal line extends through said lower water tank into said return line, said air-withdrawal line having an upper opening in said upper water tank, and a lower opening in said return line, with that region of said air-withdrawal line about said lower opening thereof being widened.

2. A heat exchanger according to claim 1, in which said region of said air-withdrawal line about said lower opening thereof is conically widened.

3. A heat exchanger according to claim 1, in which said upper water tank has an air-elimination chamber in an upper region thereof, i.e. remote from said heat exchanger tubes, with said air-withdrawal line extending into said air-elimination chamber.

4. A heat exchanger according to claim 3, in which that region of said air-withdrawal line about said upper opening thereof is widened.

5. A heat exchanger according to claim 4, in which said region of said air-withdrawal line about said upper opening thereof is conically widened.

6. A heat exchanger according to claim 1, in which said air-withdrawal line is formed by one of said heat exchanger tubes.

7. A heat exchanger according to claim 6, in which that heat exchanger tube that forms said air-withdrawal line is a single piece that is longer than the other heat exchanger tubes.

8. A heat exchanger according to claim 6, in which that heat exchanger tube that forms said air-withdrawal line has connected thereto an upper extension that extends into said upper water tank and is provided with said upper opening of said air-withdrawal line; also connected to the same heat exchanger tube is a lower extension that extends through said lower water tank and is provided with said lower opening of said air-withdrawal line.

9. A heat exchanger according to claim 1, in which said return line is disposed essentially vertically, with said air-withdrawal line also extending vertically into said return line.

10. A heat exchanger according to claim 1, in which said lower opening of said air-withdrawal line is disposed in said return line in a region thereof having a minimal cross-sectional flow area.

11. A heat exchanger according to claim 1, in which that region of said radiator that accommodates said heat exchanger tubes is known as the heat exchanger register, with that portion of said air-withdrawal line that is disposed within said heat exchanger register being aligned with said return line.

* * * * *